US012264870B2

(12) United States Patent
Wang et al.

(10) Patent No.: US 12,264,870 B2
(45) Date of Patent: Apr. 1, 2025

(54) REFRIGERATOR DOOR

(71) Applicants: QINGDAO HAIER REFRIGERATOR CO., LTD., Qingdao (CN); HAIER SMART HOME CO., LTD., Qingdao (CN)

(72) Inventors: Wenchun Wang, Qingdao (CN); Hao Zhang, Qingdao (CN); Enpin Xia, Qingdao (CN); Xuan Ji, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 225 days.

(21) Appl. No.: 17/925,609

(22) PCT Filed: Apr. 12, 2021

(86) PCT No.: PCT/CN2021/086441
§ 371 (c)(1),
(2) Date: Nov. 15, 2022

(87) PCT Pub. No.: WO2021/213200
PCT Pub. Date: Oct. 28, 2021

(65) Prior Publication Data

US 2023/0194147 A1 Jun. 22, 2023

(30) Foreign Application Priority Data

May 15, 2020 (CN) ..... 202010414342.3

(51) Int. Cl.
*F25D 23/02* (2006.01)
*F25D 23/04* (2006.01)

(52) U.S. Cl.
CPC ..... *F25D 23/028* (2013.01); *F25D 23/04* (2013.01); *F25D 2201/10* (2013.01); *F25D 2400/40* (2013.01)

(58) Field of Classification Search
CPC ..... F25D 23/04; F25D 2400/40; F25D 23/02; F25D 23/028; F25D 2201/10; H01H 36/00; H01R 13/73
See application file for complete search history.

(56) References Cited

U.S. PATENT DOCUMENTS

2001/0053066 A1* 12/2001 Malnati ..... F25D 29/005 361/752
2008/0164225 A1* 7/2008 McCoy ..... H01R 31/06 211/26.1

(Continued)

FOREIGN PATENT DOCUMENTS

CN 106052255 A 10/2016
CN 106642904 A 5/2017

(Continued)

*Primary Examiner* — Hiwot E Tefera
(74) *Attorney, Agent, or Firm* — Cheng-Ju Chiang

(57) ABSTRACT

The present invention provides a refrigerator door, comprising a door housing, a door liner, a decorative strip connected between the door liner and the door housing, a thermal insulation chamber formed between the door housing and the door liner, and a storage device mounted on the door liner. The refrigerator door further comprises a power supply module used to supply power to the storage device. The power supply module has a pre-embedded component fixed in the thermal insulation chamber and exposed by the door liner, a power supply line passing through the pre-embedded component from the thermal insulation chamber and leading out, and a connection mechanism disposed between the pre-embedded component and the storage device and electrically connected to the power supply line. The refrigerator (Continued)

door of the present invention can prevent the occurrence of leakage during a foaming process.

9 Claims, 12 Drawing Sheets

(56) References Cited

U.S. PATENT DOCUMENTS

| | | | | |
|---|---|---|---|---|
| 2009/0145138 | A1 | 6/2009 | Ethier et al. | |
| 2009/0229298 | A1* | 9/2009 | Allard | H05K 5/0247 62/449 |
| 2009/0293511 | A1* | 12/2009 | Allard | F25D 23/12 62/449 |
| 2009/0302724 | A1* | 12/2009 | Allard | B67D 3/00 312/237 |
| 2010/0276442 | A1* | 11/2010 | Querfurth | F25D 23/12 62/449 |
| 2010/0293987 | A1* | 11/2010 | Horst | H01R 12/675 174/47 |
| 2011/0110706 | A1* | 5/2011 | Allard | F25D 23/04 439/116 |
| 2018/0192807 | A1* | 7/2018 | Hall | A47B 96/1416 |
| 2021/0302093 | A1* | 9/2021 | El Sayed | F25D 23/028 |

FOREIGN PATENT DOCUMENTS

| | | | |
|---|---|---|---|
| CN | 106885418 | A | 6/2017 |
| CN | 106979654 | A | 7/2017 |
| CN | 206890943 | U | 1/2018 |

* cited by examiner

REFRIGERATOR DOOR

CROSS REFERENCE TO RELATED APPLICATIONS

The present invention is a 35 U.S.C. § 371 National Phase conversion of International (PCT) Patent Application No. PCT/CN2021/086441, filed on Apr. 12, 2021, which claims benefit of Chinese Application No. 202010414342.3, filed on May 15, 2020, the disclosure of which is incorporated by reference herein. The PCT International Patent Application was filed and published in Chinese.

TECHNICAL FIELD

The present invention relates to a refrigerator door, and particularly to a more intelligent refrigerator door.

BACKGROUND

As refrigerators develop gradually in a more intelligent tendency, storage devices on the refrigerator door have increasing functions. To achieve these functions, a powering device for powering the storage devices needs to be mounted on the door body. Therefore, in a refrigerator door, opening processing needs to be performed on a door liner so that a power supply line passes through the hole and is electrically connected with a powering device to thereby provide electrical energy for a storage device. However, the opening processing is performed on the door liner, this causes likelihood of material overflow during a foaming process and greatly reduces the yield rate of products.

In view of the above problem, it is necessary to improve the conventional refrigerator door to solve the above problem.

SUMMARY

An object of the present invention is to provide a more intelligent refrigerator door.

The present invention is directed to a refrigerator door comprising a door housing, a door liner, a decorative strip connecting the door liner with the door housing, a thermal insulation chamber formed between the door housing and the door liner, and a storage device mounted on the door liner, wherein the refrigerator door further comprises a power supply module for powering the storage device, the power supply module has a pre-embedded component fixed in the thermal insulation chamber and exposed from the door liner to the outside, a power supply line led from the thermal insulation chamber through the pre-embedded component, and a connecting mechanism disposed between the pre-embedded component and the storage device and electrically connected to the power supply line.

Further, the pre-embedded component comprises a first fixing portion fixed with the decorative strip, a second fixing portion fixed with the door liner, and a mounting mechanism protruding from the second fixing portion for mounting the connecting mechanism, and wherein the first fixing portion and the second fixing portion are connected by a plurality of connecting ribs arranged at an interval.

Further, the decorative strip comprises side decorative strips fixed on both sides of the door liner, the pre-embedded component is fixed on a side of the side decorative strip facing the thermal insulation chamber, the side decorative strip is provided with a pre-positioning structure for pre-positioning the pre-embedded component and a decorative strip fixing hole located beside the pre-positioning structure, the first fixing portion is provided with a retaining structure matching the pre-positioning structure and a fixing hole in the pre-embedded component corresponding to the decorative strip fixing hole, and the refrigerator door further has a fixing pin for fixing the decorative strip fixing hole and the fixing hole in the pre-embedded component.

Further, the decorative strip comprise side decorative strips fixed on both sides of the door liner, the first fixing portion is fixed on a side of the decorative strip facing the thermal insulation chamber, the door liner has a recessed portion on both sides for receiving the second fixing portion, the second fixing portion has a fitting wall that is fitted to an inner wall on one side of the recessed portion in the transverse direction, front and rear side walls located on front and rear sides of the fitting wall, and upper and lower side walls located on upper and lower sides of the fitting wall, the front and rear side walls and the upper and lower side walls are all fitted to the inner wall on the other side of the recessed portion in the transverse direction, and the second fixing portion has a limiting hole penetrating the upper side wall of the second fixing portion to receive the power supply line.

Further, the connecting mechanism is a hanger, and an engaging slot disposed on the storage device and configured to engage with the hanger, the power supply module comprises a first connector disposed on the hanger and a second connector disposed at the engaging slot, and the first connector and second connector are docked with each other in cooperation after the storage device is mounted.

Further, the hanger has a housing fixed on a side wall of the door liner, and a circuit board disposed in the housing, and the first connector is electrically connected to the circuit board and disposed exposed outward.

Further, the first connector has a connection terminal electrically connected to the circuit board, the housing is provided with a through hole for the connection terminal to pass therethrough, and the connection terminal has a connection portion electrically connected to the second connector and a welding portion passing through the through hole and welded with the circuit board.

Further, the power supply line is electrically connected to the circuit board, an end of the power supply line is provided with a socket, and the circuit board is provided with a plug mated with the socket.

Further, the housing has a pair of sliders protruding from inner walls of front and rear side walls thereof, opposed to each other and extending in an up-down direction, a catching slot recessed from inner walls of the side walls in the transverse direction, the mounting mechanism is protrudingly formed from the fitting wall, the mounting mechanism comprises a pair of slide rails cooperating with the pair of sliders, and a bottom plate located below the pair of slide rails, and a snap engaging with the catching slot is protrudingly disposed on a side of the bottom plate in the transverse direction.

Further, the mounting mechanism further comprises a line through hole located between the pair of slide rails and configured to allow the power supply line to pass therethrough, and the pair of slide rails are disposed connected to the bottom plate.

The advantageous effects of the present invention are as follows: in the present invention the pre-embedded component is disposed on the door liner so that the supply source line powers the storage device via the pre-embedded component. As such, the material overflow can be prevented during the foaming process.

DETAILED DESCRIPTION

Figure 1:
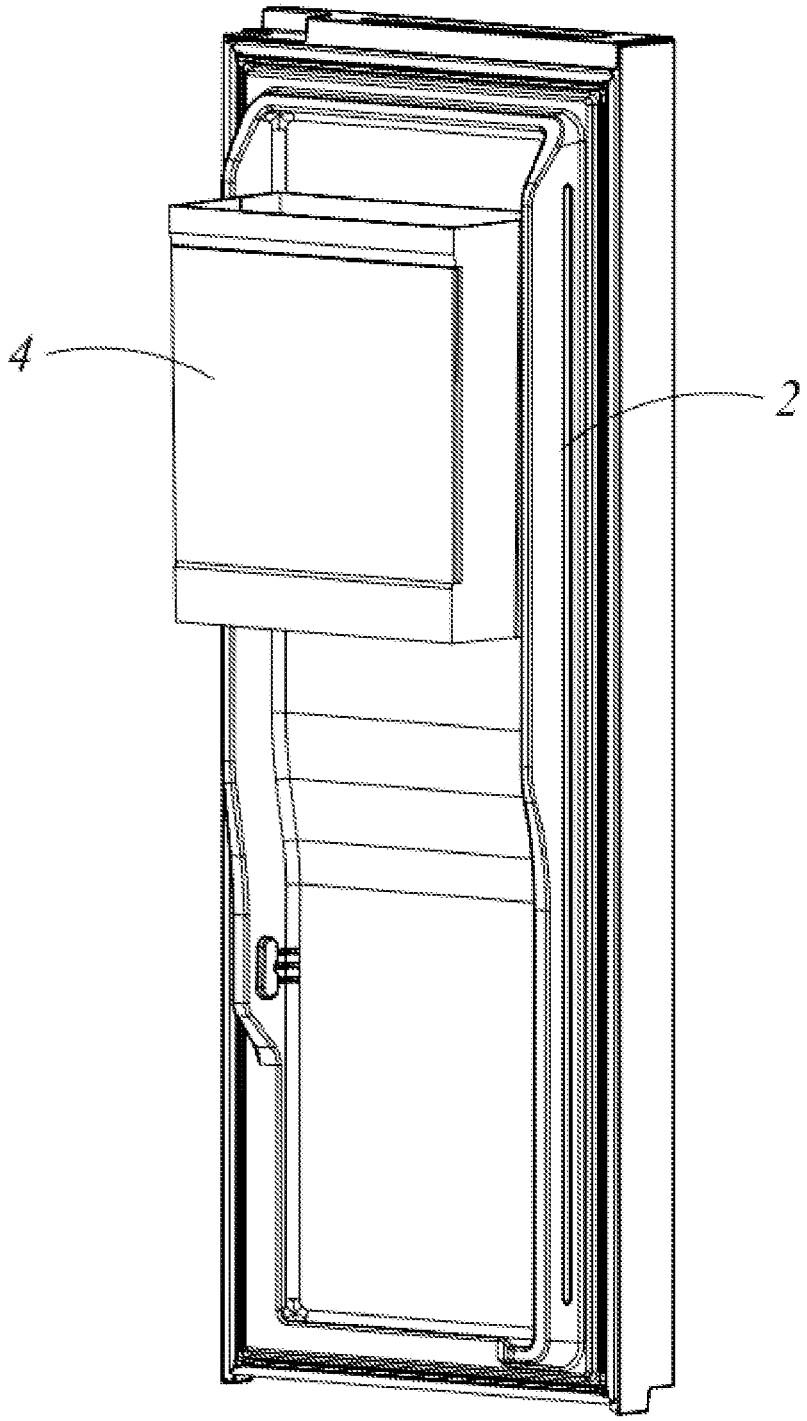
FIG. 1 is a perspective view of a refrigerator door according to the present invention.
Figure 2:
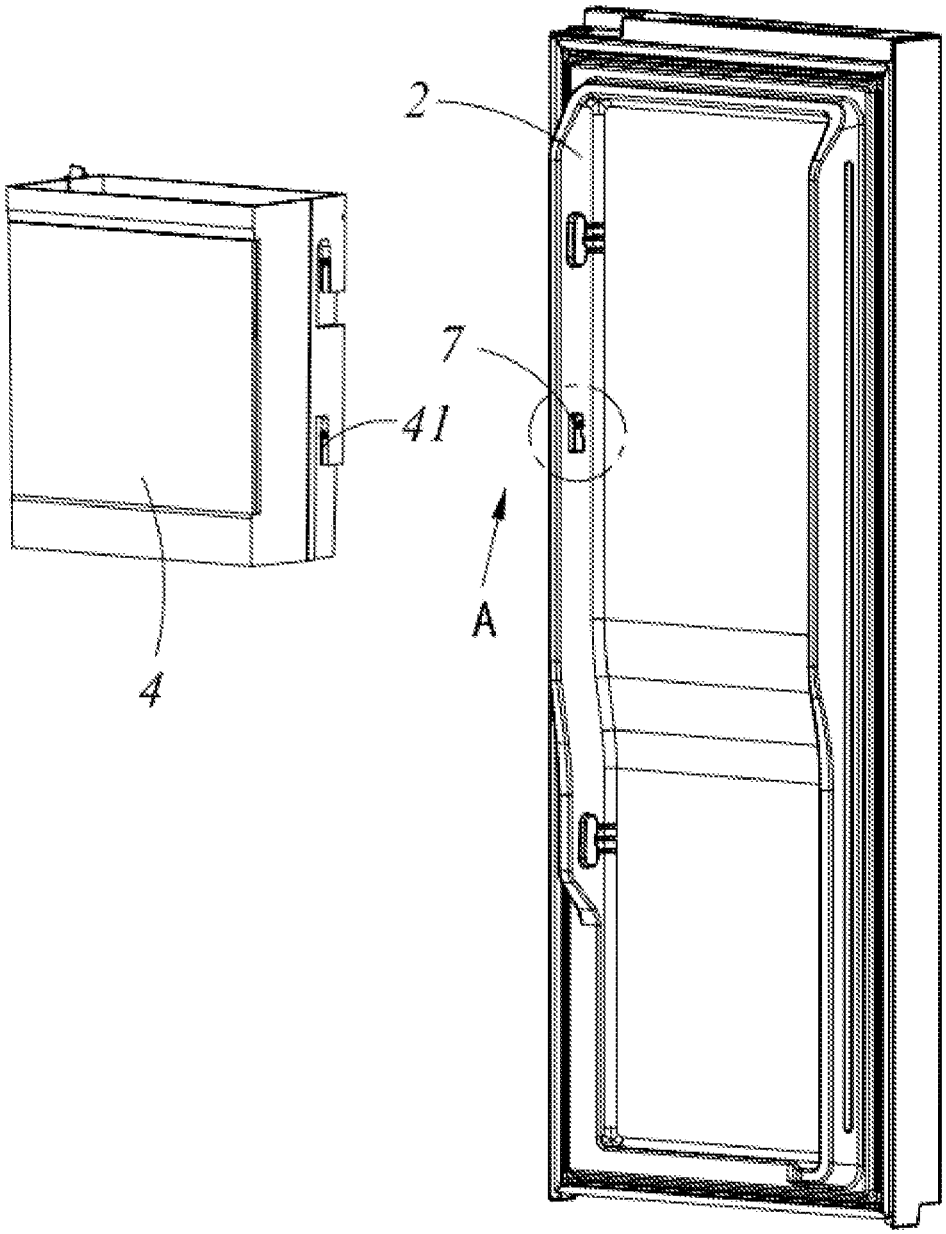
FIG. 2 is an exploded perspective view of FIG. 1.
Figure 3:
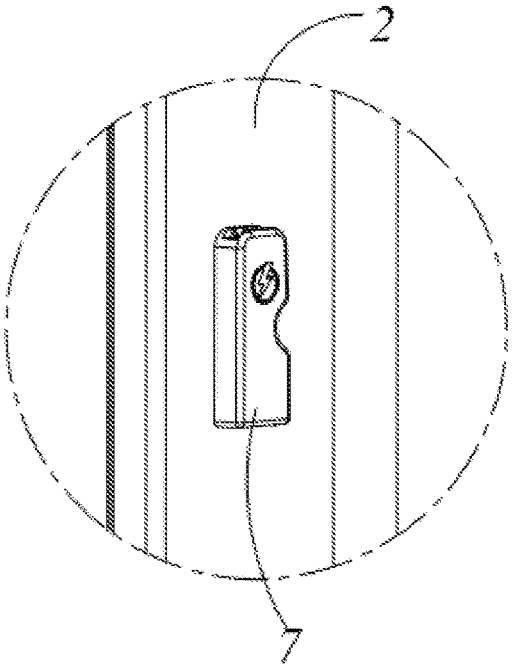
FIG. 3 is an enlarged view of location A in FIG. 1.
Figure 4:
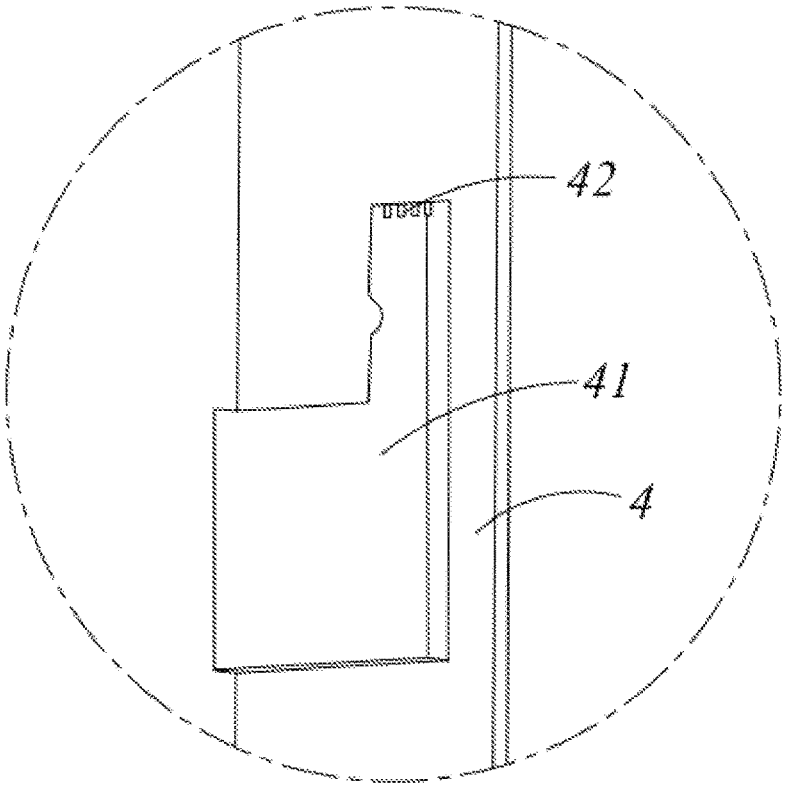
FIG. 4 is a partial perspective view of the other side of a storage device in FIG. 2.

In order to make those skilled in the art better understand the technical solutions of the present invention, the technical solutions in the embodiments of the present invention will be clearly and completely described below with reference to figures in the embodiments of the present invention. Obviously, the described embodiments are only partial embodiments of the present invention, but not all embodiments. Based on the embodiments of the present invention, all other embodiments obtained by those having ordinary skill in the art without making creative efforts should fall within the protection scope of the present invention.

Referring to FIG. 1 through FIG. 14, an embodiment of a refrigerator door of the present invention is illustrated. The refrigerator door comprises a door housing 1, a door liner 2, a decorative strip 3 connecting the door liner 2 with the door housing 1, a thermal insulation chamber formed between the door housing 1 and the door liner 2, and a storage device 4 mounted on the door liner 2, wherein the refrigerator door further comprises a power supply module for powering the storage device 4, the power supply module has a pre-embedded component 5 fixed in the thermal insulation chamber and exposed from the door liner 2 to the outside, a power supply line 6 led from the thermal insulation chamber through the pre-embedded component 5, and a connecting mechanism disposed between the pre-embedded component 5 and the storage device 4 and electrically connected to the power supply line 6.

Figure 11:
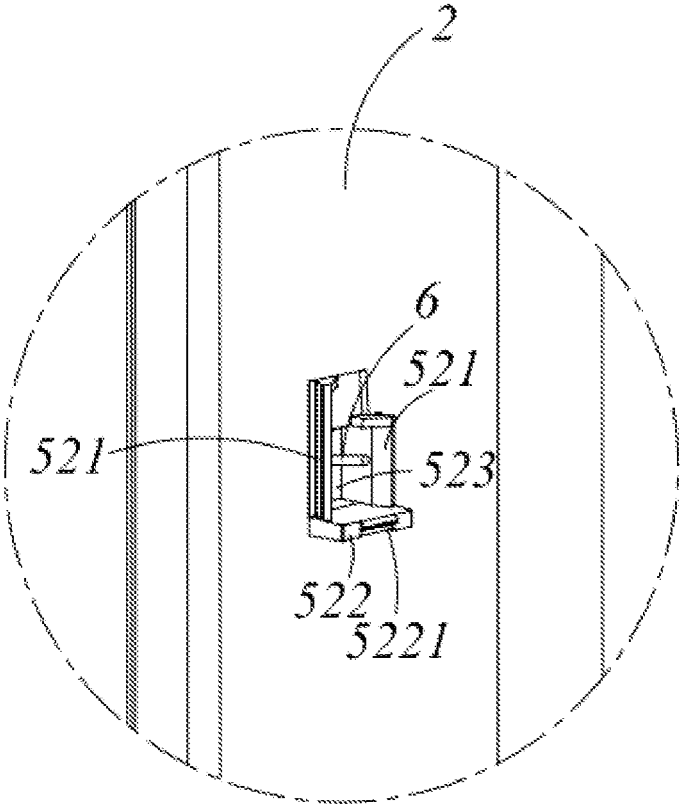
FIG. 11 is an enlarged view of location C in FIG. 10.
Figure 12:
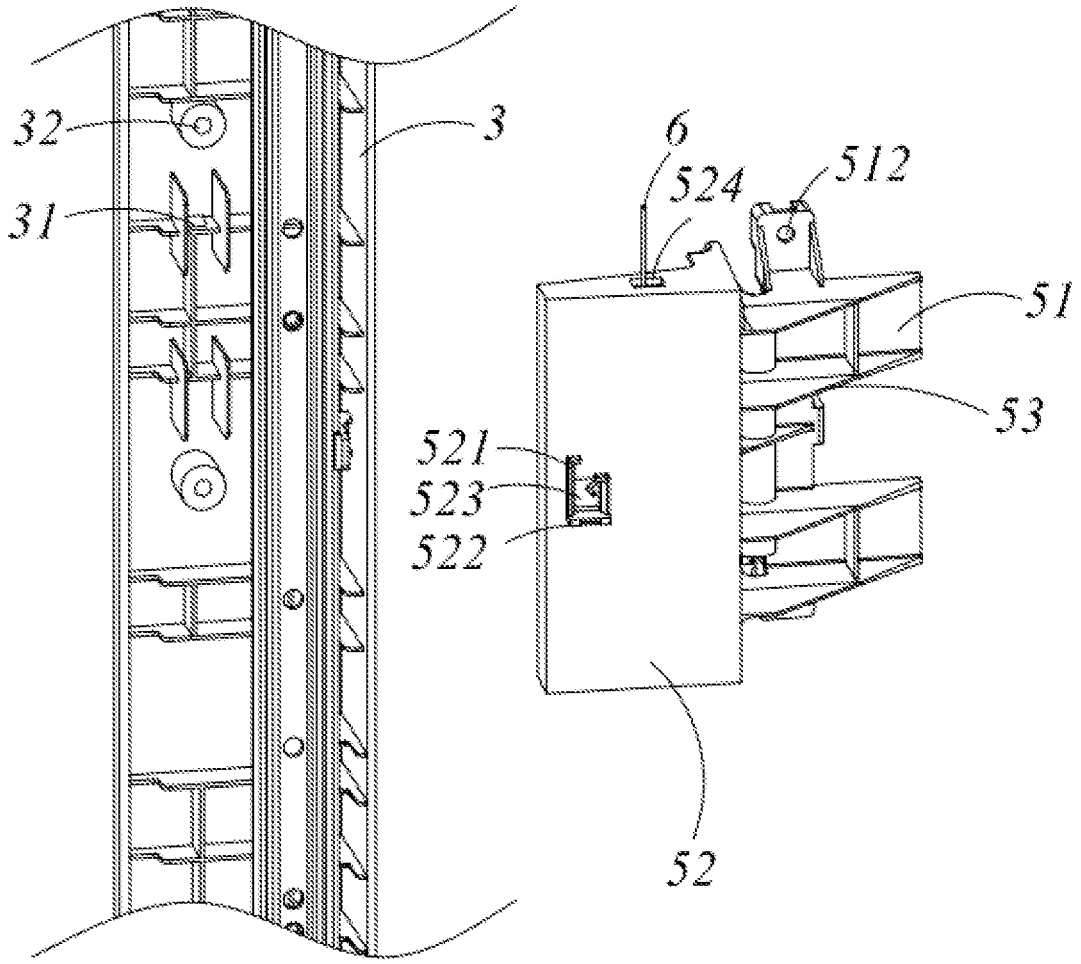
FIG. 12 is an exploded perspective view of a decorative strip and the pre-embedded component in FIG. 8.
Figure 13:
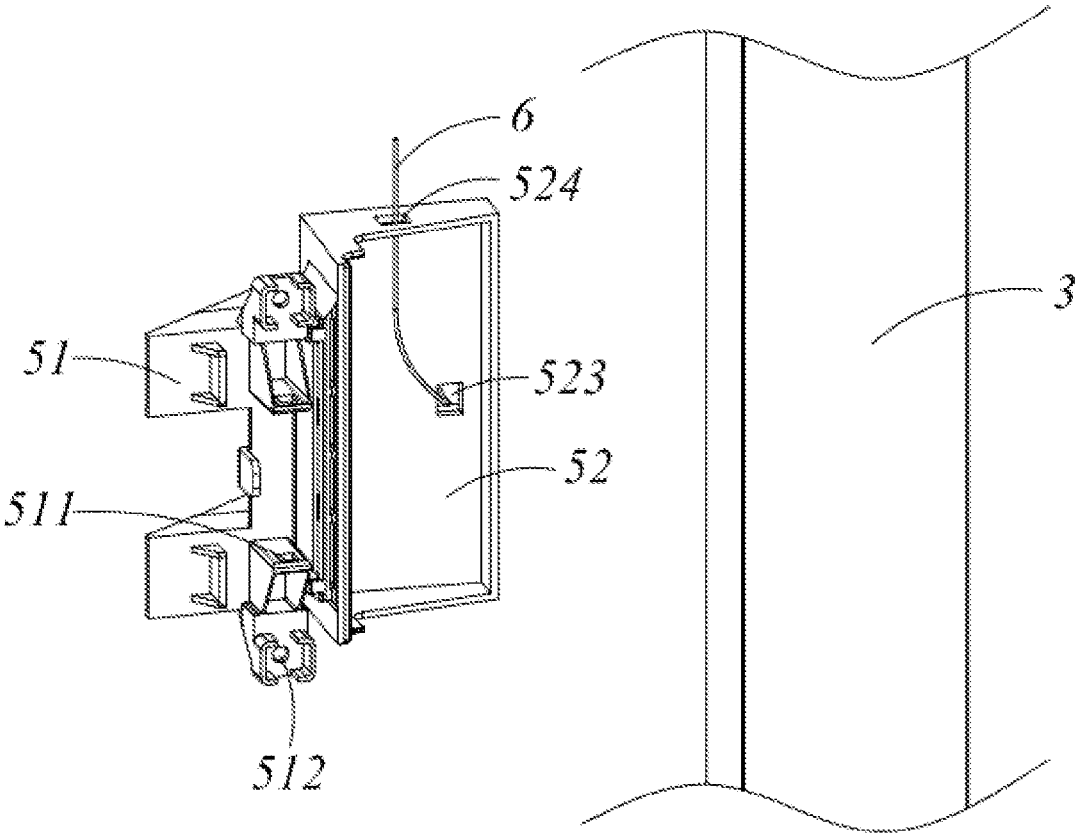
FIG. 13 is an exploded perspective view of FIG. 12 from another perspective.

Specifically, as shown in FIG. 11 through FIG. 13, the pre-embedded component 5 comprises a first fixing portion 51 fixed with the decorative strip 3, a second fixing portion 52 fixed with a side wall of the door liner 2, and a mounting mechanism protruding from the second fixing portion 52 for mounting the connecting mechanism, wherein the first fixing portion 51 and the second fixing portion 52 are connected by a plurality of connecting ribs 53 arranged at an interval in an up-down direction. As such, when the storage device 4 is mounted on a hanger 7, the storage device 4 is borne by a side decorative strip 3, thereby preventing the door liner 2 from being damaged, and thereby ensuring good electrical connection between the hanger 7 and the storage device 4.

The side wall of the door liner 2 has a mounting hole 21 which runs through in the transverse direction. The mounting mechanism protrudes through the mounting hole 21 out of the side wall of the door liner 2 to facilitate the mounting of the hanger 7, the mounting mechanism comprises a pair of slide rails 521 arranged at an interval in a front-rear direction and extending in an up-down direction, and a bottom plate 522 located below the pair of slide rails 521, and a snap 5221 is protrudingly disposed on a side of the bottom plate 522 in the transverse direction.

In the present embodiment, the mounting mechanism further comprises a line through hole 523 located between the pair of slide rails 521 and configured to allow the power supply line 6 to pass therethrough, and the pair of slide rails 521 are disposed connected to the bottom plate 522. As such, the structural strength of the slide rails 521 and the bottom plate 522 can be increased.

Figure 14:
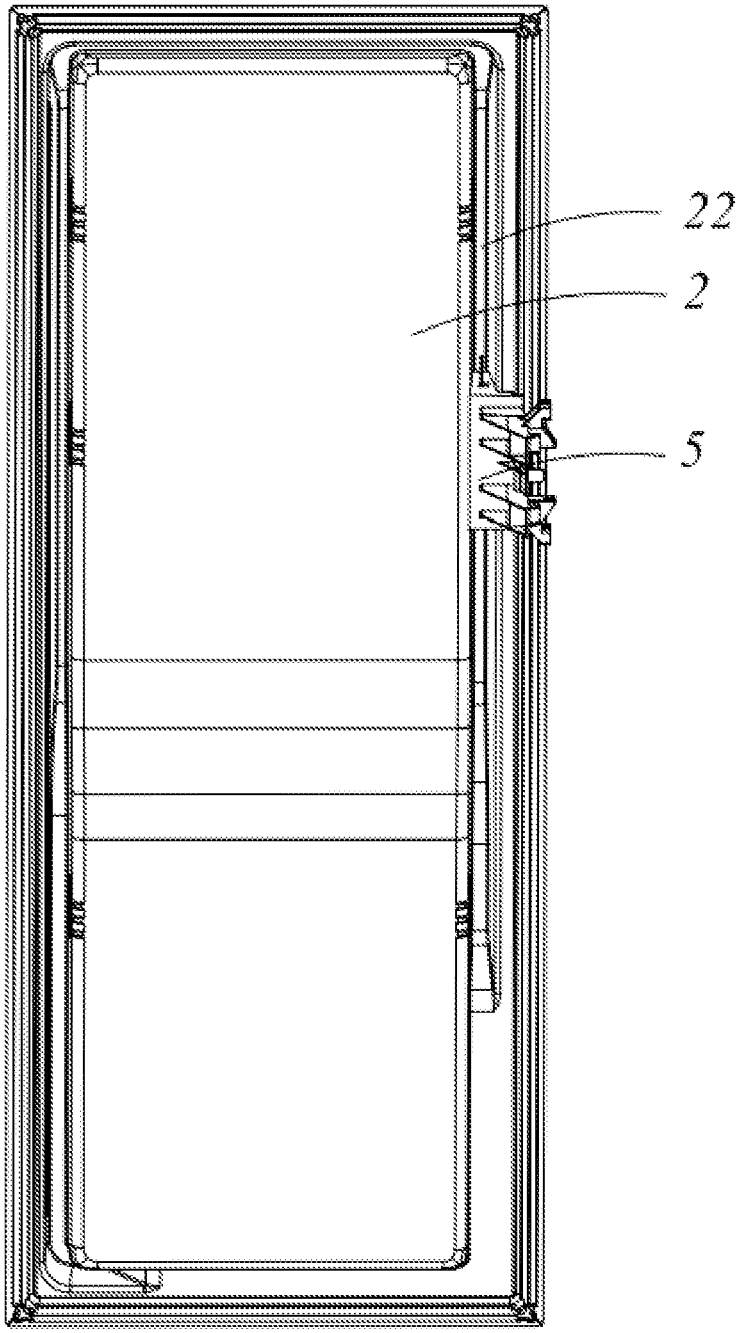
FIG. 14 is a perspective view showing that the pre-embedded component is disposed on the inner deer panel door liner.

In the present embodiment, as shown in FIG. 1 and FIG. 14, the door liner 2 is formed by vacuum molding, and the door liner 2 is arranged in an inwardly opened U-shape. Specifically, the door liner 2 has a recessed portion 22 on both sides of the door liner 2 in the transverse direction, the recessed portions 22 are disposed gradually narrowed from front to rear, and the recessed portions 22 are side walls of the door liner 2 as viewed from outside.

The second fixing portion 52 has a fitting wall that is fitted to an inner wall on one side of the recessed portion 22 in the transverse direction, front and rear side walls located on front and rear sides of the fitting wall, and upper and lower side walls located on upper and lower sides of the fitting wall, the front and rear side walls and the upper and lower side walls are all fitted to the inner wall on the other side of the recessed portion 22 in the transverse direction, wherein the mounting mechanism is protrudingly formed from the fitting wall. As such, the periphery of the second fixing portion 52 can fit the recessed portion 22 seamlessly, thereby avoiding the occurrence of material overflow during the foaming process.

The second fixing portion 52 further has a limiting hole 524 penetrating the upper side wall of the second fixing portion 52 in the up-down direction to receive the power supply line 6. As such, the power supply line 6 can be smoothly connected to the hanger 7, and meanwhile, since the diameter of the limiting hole 524 is small, the occurrence of material overflow during the foaming process can be further avoided.

In the present embodiment, the decorative strip comprises side decorative strips 3 fixed on both sides of the door liner 2, the pre-embedded component 5 is fixed on a side of the side decorative strip 3 facing the thermal insulation chamber, the side decorative strip 3 is provided with a pre-positioning structure for pre-positioning the pre-embedded component 5 and a decorative strip fixing hole 32 located beside the pre-positioning structure, the first fixing portion 51 is provided with a retaining structure matching the pre-positioning structure and a fixing hole 512 in the pre-embedded component 5 corresponding to the decorative strip fixing hole 32, and the refrigerator door further has a fixing pin for fixing the decorative strip fixing hole 32 and the fixing hole 512 in the pre-embedded component 5.

Specifically, the pre-positioning structure is a pair of hooks 31 disposed on the side decorative strip 3 at an interval in the up-down direction, and the retaining structure is a snap-fitting groove 511 disposed in the first fixing portion 51. Certainly, in other embodiments, when the hanger 7 is located at a higher position, the pre-embedded component 5 can also be fixed to the upper decorative strip, or fixed to other structures, such as a reinforcing member.

As shown in FIG. 1 to FIG. 4, the storage device 4 has an engaging slot 41 for engaging with the hanger 7. the power supply module comprises a first connector 71 disposed on the hanger 7, and a second connector 42 disposed at the engaging slot 41, wherein the first connector 71 and second connector 42 are docked with each other in cooperation after the storage device 4 is mounted. In the present embodiment, the connecting mechanism is the hanger 7, and the engaging slot 41 disposed on the storage device 4 and configured to engage with the hanger 7.

Figure 5:
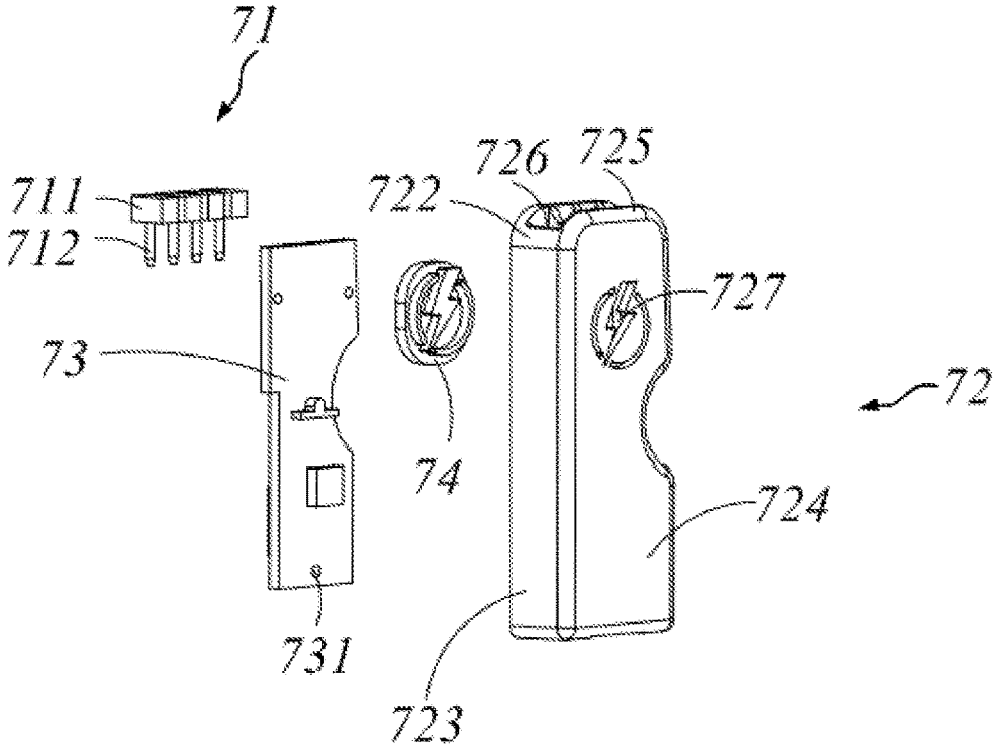
FIG. 5 is an exploded perspective view of a hanger in FIG. 2.
Figure 6:
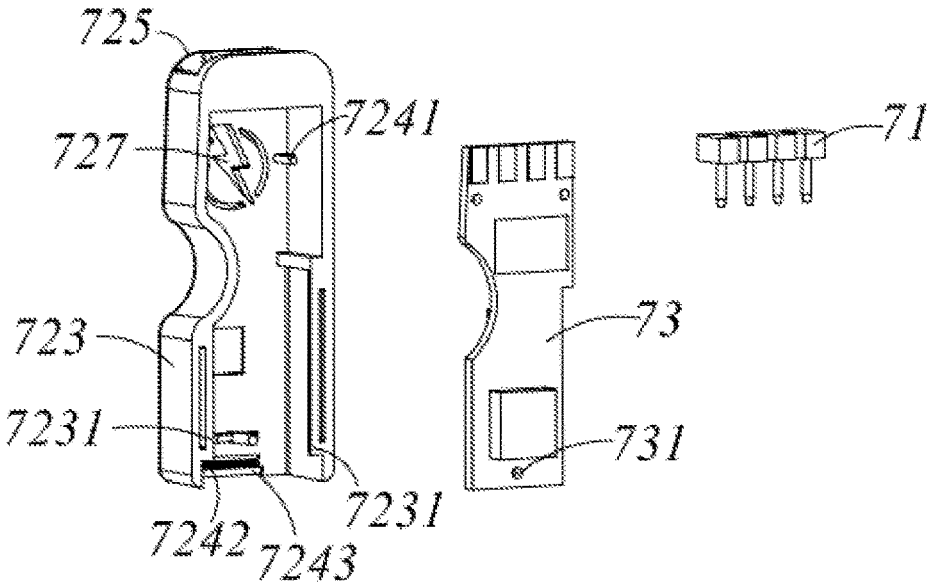
FIG. 6 is an exploded perspective view of FIG. 5 from another perspective.
Figure 7:
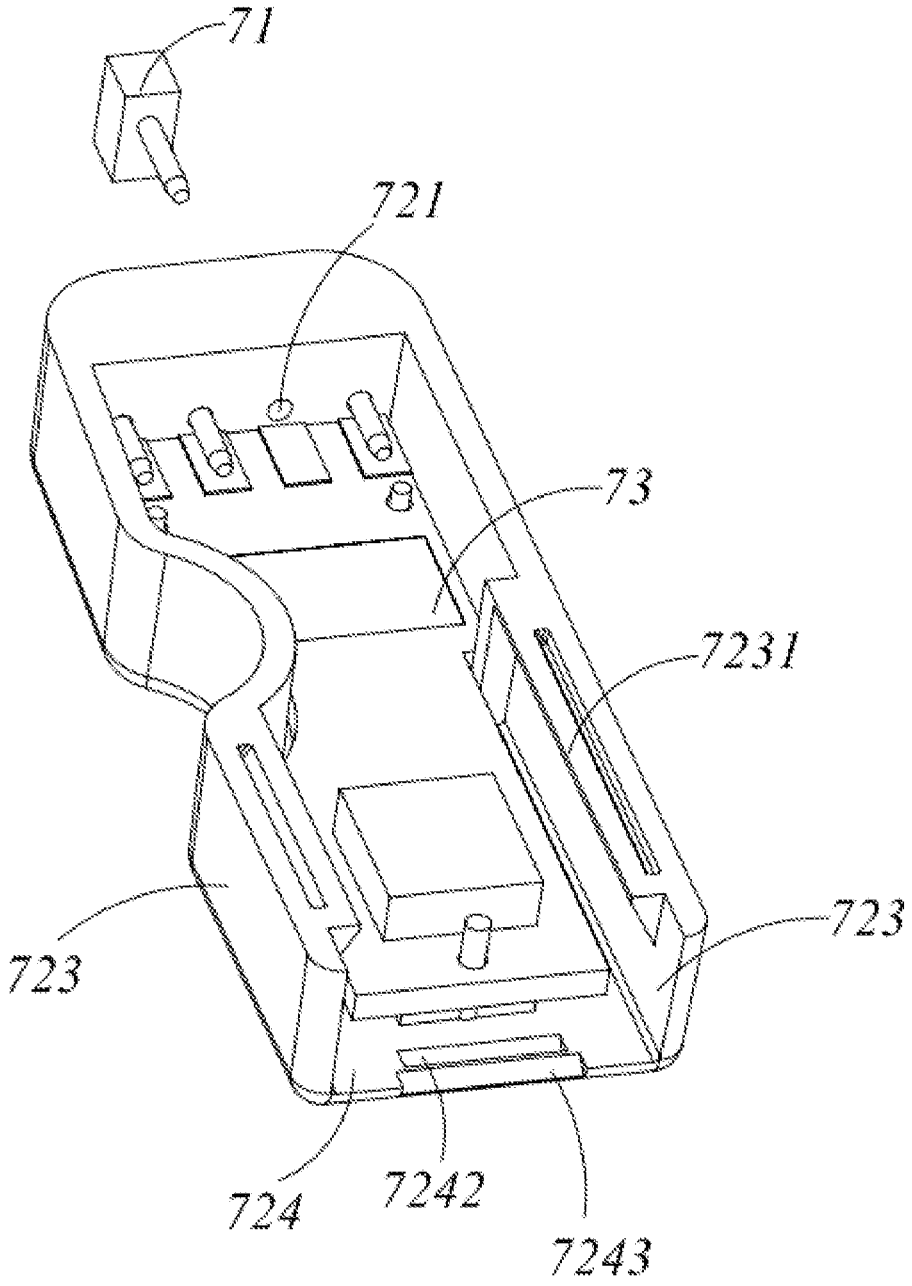
FIG. 7 is an exploded perspective view of the hanger in FIG. 5 from another perspective.
Figure 8:
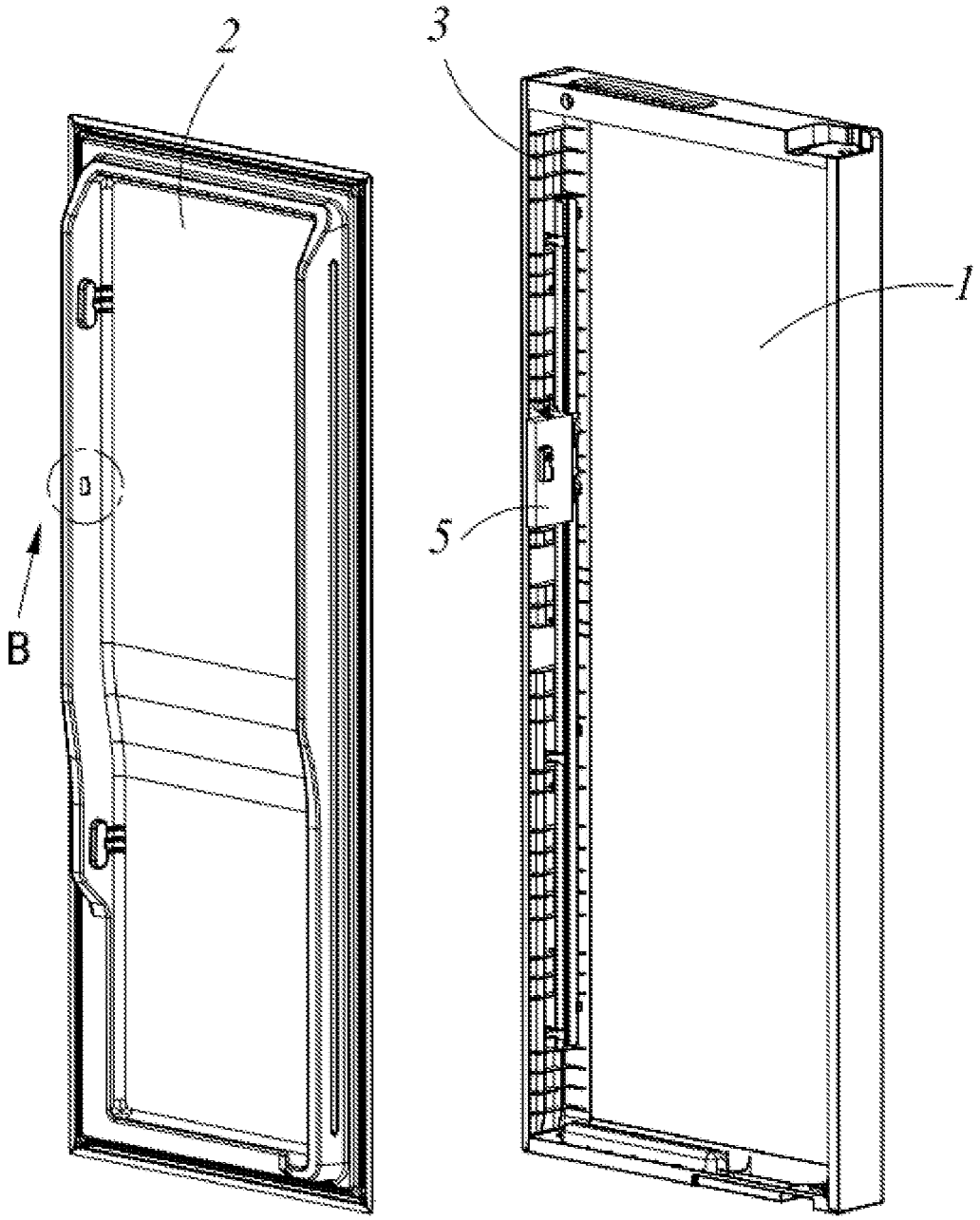
FIG. 8 is an exploded perspective view of the refrigerator door after a storage device is hidden.
Figure 9:
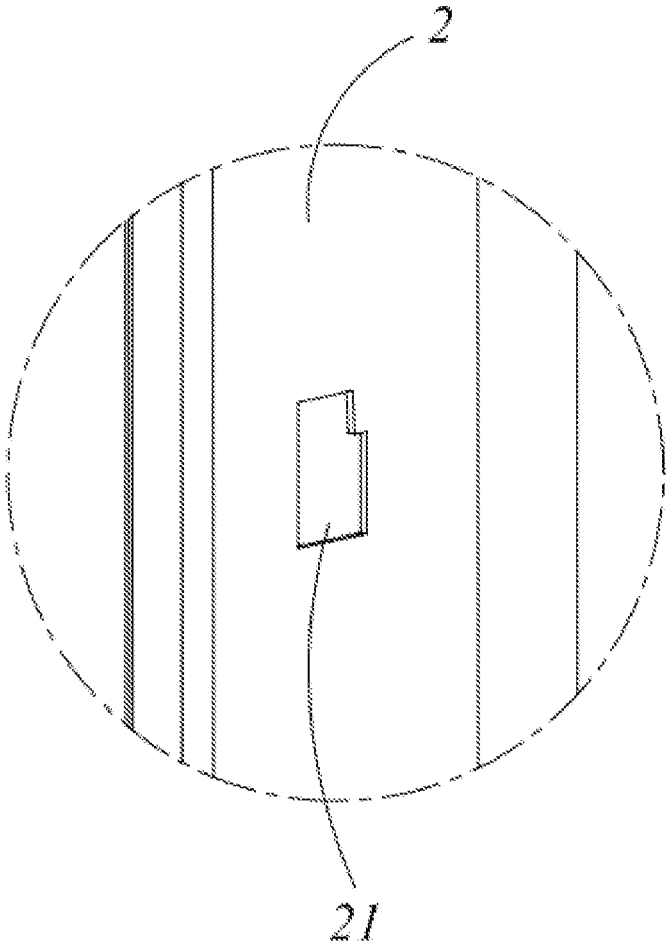
FIG. 9 is an enlarged view of location B in FIG. 8.
Figure 10:
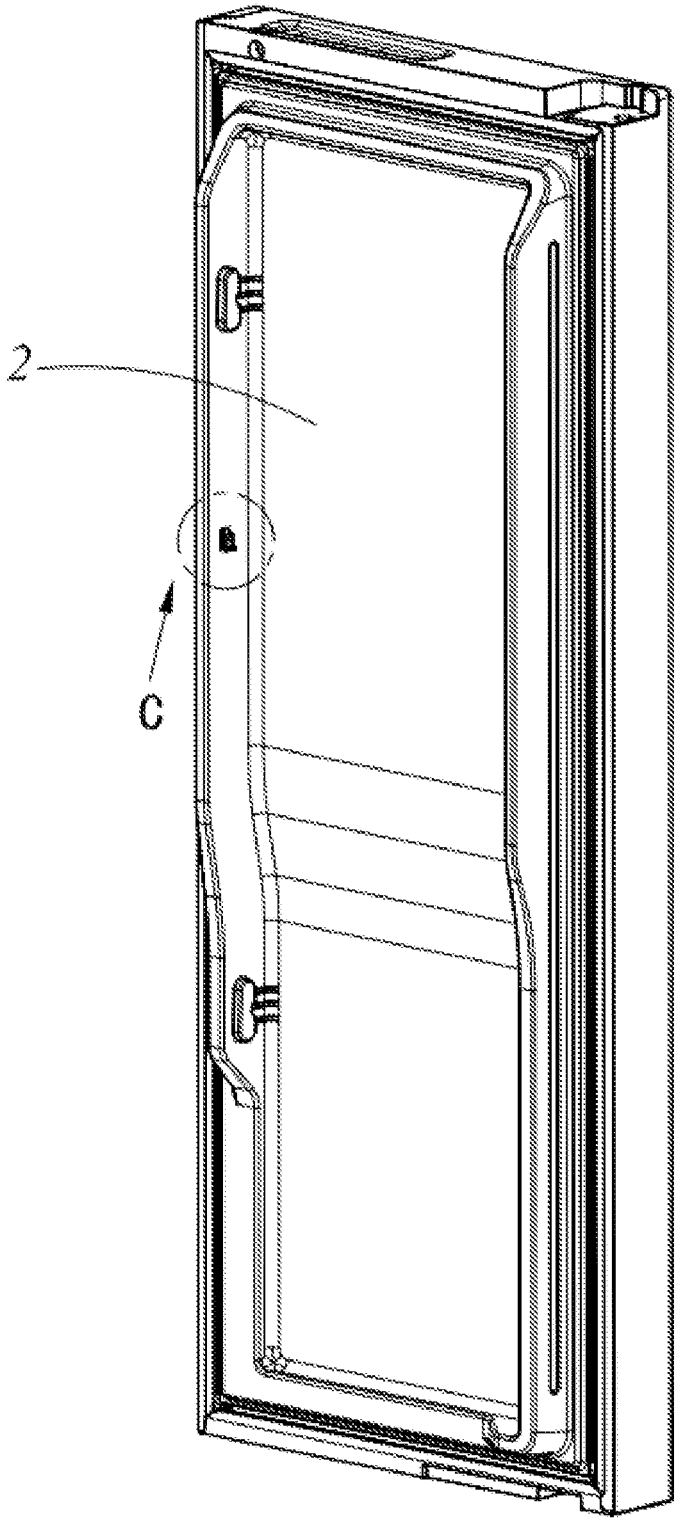
FIG. 10 is a perspective view of the refrigerator door after a hanger is hidden.

As shown in FIGS. 5-7, the hanger 7 has a housing 72 fixed on a side wall of the door liner 2, a circuit board 73 fixed in the housing 72, and the first connector 71 is electrically connected to the circuit board 73 and disposed exposed out of the housing 72.

The first connector 71 has a connection terminal electrically connected to the circuit board 73, the housing 72 is provided with a through hole 721 for the connection terminal to pass therethrough, and the connection terminal has a connection portion 711 electrically connected to the second connector 42 and a welding portion 712 passing through the through hole 721 and welded with the circuit board 73. In the present embodiment, the first connector 71 is the connection terminal.

In the present embodiment, the housing 72 has a support wall 722 located atop, a pair of first side walls 723 that are disposed spaced-apart in a front-rear direction and connected to the support wall 722, and second side walls 724 disposed transversely and connected to the pair of first side walls 723 and the support wall 722, the through hole 721 runs through the support wall 722 in a top-down direction, the connection portion 711 is exposed out of an upper surface of the support wall 722, and the second connector 42 is disposed on an upper inner wall of the engaging slot 41.

The first side walls 723 are arranged asymmetrically, and side edges of the circuit board 73 facing the inner walls of the first side walls 723 are also arranged asymmetrically. In the present embodiment, one of the first side walls 723 has a recess which is inwardly recessed and cooperates with a protrusion on the engaging slot 41 to fix the storage device 4. As such, the hanger 7 and the circuit board 73 can be mounted conveniently to avoid a mounting error.

Certainly, in other embodiments, the through hole 721 can also be disposed on the first side wall 723 or the second side wall 724, the connection portion 711 is exposed on an outer surface of the first side wall 723 or the second side wall 724, and the second connector 42 only needs to be disposed in the engaging slot 41 at a position corresponding to the first side wall 723 or the second side wall 724.

The housing 72 further has a shielding portion 725 formed on a side of the support wall 722 in a transverse direction and close to the storage device 4, the support wall 722 is formed with an inner recess 726 that is recessed downward, and the connection portion 711 is located in a space formed by the inner recess 726 and the shielding portion 725. As such, the first connector 71 is fixed more firmly, and furthermore, when the storage device 4 is mounted on the hanger 7, the shielding portion 725 can shield the first connector 71 and the second connector 42 to increase the aesthetics.

An end of the power supply line 6 is provided with a socket, and the circuit board 73 is provided with a plug mated with the socket. As such, when the hanger 7 is damaged, it can be easily detached for replacement or maintenance.

Certainly, in other embodiments, the power supply line 6 can also be directly connected to the first connector 71 or the circuit board 73 to power the second connector 42. For example, the first connector 71 is a socket disposed at the end of the power supply line 6, and the second connector 42 is a plug mated with the socket. As such, the structure is very simple and the cost is low.

In the present embodiment, the second side wall 724 has a plurality of positioning posts 7241 formed protruding from an inner wall thereof, the circuit board 73 has positioning holes 731 mated with the positioning posts 7241, and then the circuit board 73 is fixed on the housing 72 by gluing or in a snap-fitting manner. As such, more electrical components can be disposed on the circuit board 73 to meet more demands and realize more functions, for example, a function of preventing electric shock.

The housing 72 further has a pair of sliders 7231 protruding from inner walls of the pair of first side walls 723, opposed to each other and extending in an up-down direction, and a catching slot 7242 recessed from an inner wall of the second side wall 724. The inner wall of the second side wall 724 further has a guide portion 7243 that is located below the catching slot 7242 and disposed inclined.

The hanger 7 further has an indicator light 74 disposed on the circuit board 73, and the side wall of the housing 72 in the transverse direction has a hollowed portion 727 that matches the shape of the indicator light 34 to accommodate the indicator light 74. The indicator light 74 can be used to indicate whether the hanger 7 is in a power-on state, that is, the indicator light 74 indicates that the hanger 7 is in the power-on state when it is on; the indicator light 74 can also indicates that the hanger 7 is in a power-off state, which can be set according to actual needs.

For example, the hanger 7 is set in the power-on state when the indicator light 74 is on, so that the user can be reminded to be careful that the hanger 7 is electrified when the storage device 4 is not mounted. Alternatively, the hanger 7 is set in the power-off state when the indicator light 74 is on. As such, when the storage device 4 is not mounted, the indicator light 74 can indicate to the user that the hanger 7 is in a safe state, and operations of the hanger 7 such as repair and replacement can be performed.

Specifically, in the present embodiment, the power supply line 6 can be led from a door body hinge to the line through hole 523 of a fixing member, and then the line through hole 523 is sealed by a sealing member, and the foaming is stated. After the completion of foaming, the power supply line 6 is exposed between the slide rails 521. When the hanger 7 is mounted, the power supply line 6 is first plugged on the circuit board 73, then the sliders 7231 on the housing 72 are aligned with the slide rails 521 and slid from top to bottom, the catching slot 7242 and the snap 5221 are made smoothly snap-fitted with each other, and finally the storage device 4 is mounted on the hanger 7 to achieve electrical connection.

To conclude, in the refrigerator door of the present invention, the pre-embedded component 5 is disposed on the door liner 2, so that the power supply line 6 powers the storage device 4 via the pre-embedded component 5. As such, the occurrence of material overflow can be prevented during the foaming process; meanwhile, the pre-embedded component 5 is fixed on the side decorative strips 3, and the weight of the storage device 4 is borne by the side decorative strips 3, thereby avoiding damages to the door liner 2 and enhancing the stability of the electrical connection.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments can be combined properly to form other embodiments which can be understood by those skilled in the art.

So far, a person skilled in the art shall know that although a plurality of exemplary embodiments of the present invention have been described above in detail, various variations and improvements can be directly determined or deducted from the content disclosed by the present invention without departing from the spirit and scope of the present invention. Therefore, all those variations and improvements shall be deemed to be covered by the scope of the present invention.

What is claimed is:

1. A refrigerator door, comprising:

a door housing;

a door liner;

a decorative strip connecting the door liner with the door housing;

a thermal insulation chamber formed between the door housing and the door liner; and a storage device mounted on the door liner;

wherein the refrigerator door further comprises a power supply module for powering the storage device, the power supply module has a pre-embedded component fixed in the thermal insulation chamber and exposed from the door liner to the outside, a power supply line led from the thermal insulation chamber through the pre-embedded component, and a connecting mechanism disposed between the pre-embedded component and the storage device and electrically connected to the power supply line;

wherein the pre-embedded component comprises a first fixing portion fixed with the decorative strip, a second fixing portion fixed with the door liner, and a mounting mechanism protruding from the second fixing portion for mounting the connecting mechanism, and wherein the first fixing portion and the second fixing portion are connected by a plurality of connecting ribs arranged at an interval;

wherein the decorative strip comprises side decorative strips fixed on both sides of the door liner, the first fixing portion is fixed on a side of the decorative strip facing the thermal insulation chamber, the door liner has a recessed portion on both sides for receiving the second fixing portion, the second fixing portion has a fitting wall that is fitted to an inner wall on one side of the recessed portion in the transverse direction, front and rear side walls located on front and rear sides of the fitting wall, and upper and lower side walls located on upper and lower sides of the fitting wall, the front and rear side walls and the upper and lower side walls are all fitted to the inner wall on the other side of the recessed portion in the transverse direction, and the second fixing portion has a limiting hole penetrating the upper side wall of the second fixing portion to receive the power supply line.

2. The refrigerator door according to claim 1, wherein the connecting mechanism is a hanger, and an engaging slot disposed on the storage device and configured to engage with the hanger, the power supply module comprises a first connector disposed on the hanger and a second connector disposed at the engaging slot, and the first connector and second connector are docked with each other in cooperation after the storage device is mounted.

3. The refrigerator door according to claim 2, wherein the hanger has a housing fixed on a side wall of the door liner, and a circuit board disposed in the housing, and the first connector is electrically connected to the circuit board and disposed exposed outward.

4. The refrigerator door according to claim 3, wherein the first connector has a connection terminal electrically connected to the circuit board, the housing is provided with a through hole for the connection terminal to pass therethrough, and the connection terminal has a connection portion electrically connected to the second connector and a welding portion passing through the through hole and welded with the circuit board.

5. The refrigerator door according to claim 3, wherein the power supply line is electrically connected to the circuit board, an end of the power supply line is provided with a socket, and the circuit board is provided with a plug mated with the socket.

6. The refrigerator door according to claim 3, wherein the housing has a pair of sliders protruding from inner walls of front and rear side walls thereof, opposed to each other and extending in an up-down direction, a catching slot recessed from inner walls of the side walls in the transverse direction, the mounting mechanism is protrudingly formed from the fitting wall, the mounting mechanism comprises a pair of slide rails cooperating with the pair of sliders, and a bottom plate located below the pair of slide rails, and a snap engaging with the catching slot is protrudingly disposed on a side of the bottom plate in the transverse direction.

7. The refrigerator door according to claim 6, wherein the mounting mechanism further comprises a line through hole located between the pair of slide rails and configured to allow the power supply line to pass therethrough, and the pair of slide rails are disposed connected to the bottom plate.

8. A refrigerator door, comprising:

a door housing;

a door liner;

a decorative strip connecting the door liner with the door housing;

a thermal insulation chamber formed between the door housing and the door liner; and a storage device mounted on the door liner;

wherein the refrigerator door further comprises a power supply module for powering the storage device, the power supply module has a pre-embedded component fixed in the thermal insulation chamber and exposed from the door liner to the outside, a power supply line led from the thermal insulation chamber through the pre-embedded component, and a connecting mechanism disposed between the pre-embedded component and the storage device and electrically connected to the power supply line;

wherein the pre-embedded component comprises a first fixing portion fixed with the decorative strip, a second fixing portion fixed with the door liner, and a mounting mechanism protruding from the second fixing portion for mounting the connecting mechanism, and wherein the first fixing portion and the second fixing portion are connected by a plurality of connecting ribs arranged at an interval;

wherein the decorative strip comprises side decorative strips fixed on both sides of the door liner, the pre-embedded component is fixed on a side of the side decorative strip facing the thermal insulation chamber, the side decorative strip is provided with a pre-positioning structure for pre-positioning the pre-embedded component and a decorative strip fixing hole located beside the pre-positioning structure, the first fixing portion is provided with a retaining structure matching the pre-positioning structure and a fixing hole in the pre-embedded component corresponding to the decorative strip fixing hole, and the refrigerator door further has a fixing pin for fixing the decorative strip fixing hole and the fixing hole in the pre-embedded component.

9. The refrigerator door according to claim 8, wherein the pre-positioning structure is a pair of hooks disposed on the side decorative strip at an interval in an up-down direction, and the retaining structure is a snap-fitting groove disposed in the first fixing portion.

* * * * *